US006478650B1

(12) United States Patent
Tsai

(10) Patent No.: US 6,478,650 B1
(45) Date of Patent: Nov. 12, 2002

(54) TOY CONSTRUCTION KIT HAVING MOVABLE MEMBERS

(75) Inventor: Chia Hsiang Tsai, Chong Ho (TW)

(73) Assignee: 3E Enterprise Ltd., Taipei Hsien (TW)

( * ) Notice: Subject to any disclaimer, the term of this patent is extended or adjusted under 35 U.S.C. 154(b) by 0 days.

(21) Appl. No.: 09/968,138

(22) Filed: Sep. 28, 2001

(51) Int. Cl.[7] ..... A63H 33/12

(52) U.S. Cl. ..... 446/102; 446/125; 446/61; 446/66

(58) Field of Search ..... 446/102, 88, 84, 446/34, 93, 60–62, 66, 105–109, 112, 124, 125, 36; 273/156, 157 R; 434/211; D21/301, 430, 447, 449, 450, 479, 582, 583; 156/256

(56) References Cited

U.S. PATENT DOCUMENTS 2,347,561 A * 4/1944 Howard et al.
2,414,716 A * 1/1947 Carson
3,729,862 A * 5/1973 Halsey
4,065,220 A * 12/1977 Ruga ..... 403/169
D256,816 S * 9/1980 McMahon et al. ..... D21/89
4,253,897 A * 3/1981 Pistone ..... 156/256
D265,329 S * 7/1982 Craig ..... D21/88
D309,164 S * 7/1990 Antonucci ..... D21/89
5,007,875 A * 4/1991 Dasa ..... 446/66
5,707,268 A * 1/1998 Outman ..... 446/112
5,853,312 A * 12/1998 Li ..... 446/61
6,257,946 B1 * 7/2001 Yang ..... 446/34

* cited by examiner

*Primary Examiner*—Derris H. Banks
*Assistant Examiner*—Jamila Williams

(57) ABSTRACT

A toy construction kit includes a number of members assembled together with an edge-and-slot engagement. A support member includes a neck and a panel, and a rotary member includes an orifice for receiving the neck of the support member and for rotatably securing the rotary member onto the support member. The panel includes two portions foldable relative to each other for engaging into the orifice of the rotary member, and a latch for locking the portions together after the portions are engaged through the orifice of the rotary member.

6 Claims, 8 Drawing Sheets

TOY CONSTRUCTION KIT HAVING MOVABLE MEMBERS

BACKGROUND OF THE INVENTION

1. Field of the Invention

The present invention relates to a toy construction kit, and more particularly to a toy construction kit having one or more movable members.

2. Description of the Prior Art

Typical toy construction kits comprise a number of members or elements that may be formed or punched or cut from a planer plate or the like. The members or the elements, after being disengaged from the plate, may be assembled together by the users themselves, particularly the children, for education purposes, for example. However, the members or the elements of the toy construction kits are solidly secured together and may not be moved or rotated relative to each other, such that the typical toy construction kits are normally discarded by the users right after they have been assembled, or even before they are assembled together.

The present invention has arisen to mitigate and/or obviate the afore-described disadvantages of the conventional toy construction kits.

SUMMARY OF THE INVENTION

The primary objective of the present invention is to provide a toy construction kit including one or more movable members that may be movably or rotatably attached on a toy construction kit body, for further increasing the education purposes and the recreation purposes.

In accordance with one aspect of the invention, there is provided a toy construction kit comprising a plurality of members each including at least one edge and each including at least one slot formed therein, the edges of the members being selectively engaged in the slot of the members for allowing the members to be assembled together, a first of the members including a neck and a panel extended therefrom, and a rotary member including an orifice formed therein for receiving the neck of the first member and for rotatably securing the rotary member onto the first member.

The panel includes two portions foldable relative to each other for allowing the portions of the panel to be engaged into the orifice of the rotary member.

The panel includes a longitudinal groove formed therein and formed between the two portions thereof for forming a hinge portion between the two portions of the panel and for allowing the two portions of the panel to be folded relative to each other.

A device is further provided for locking the two portions of the panel with each other and includes a latch engaged with the two portions of the panel for locking the two portions of the panel with each other.

The two portions of the panel each includes a channel formed therein for receiving the latch, and each includes a pair of inclined surfaces formed thereon, the latch includes a pair of inclined surfaces formed thereon and aligned with and flushed with the inclined surfaces of the panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
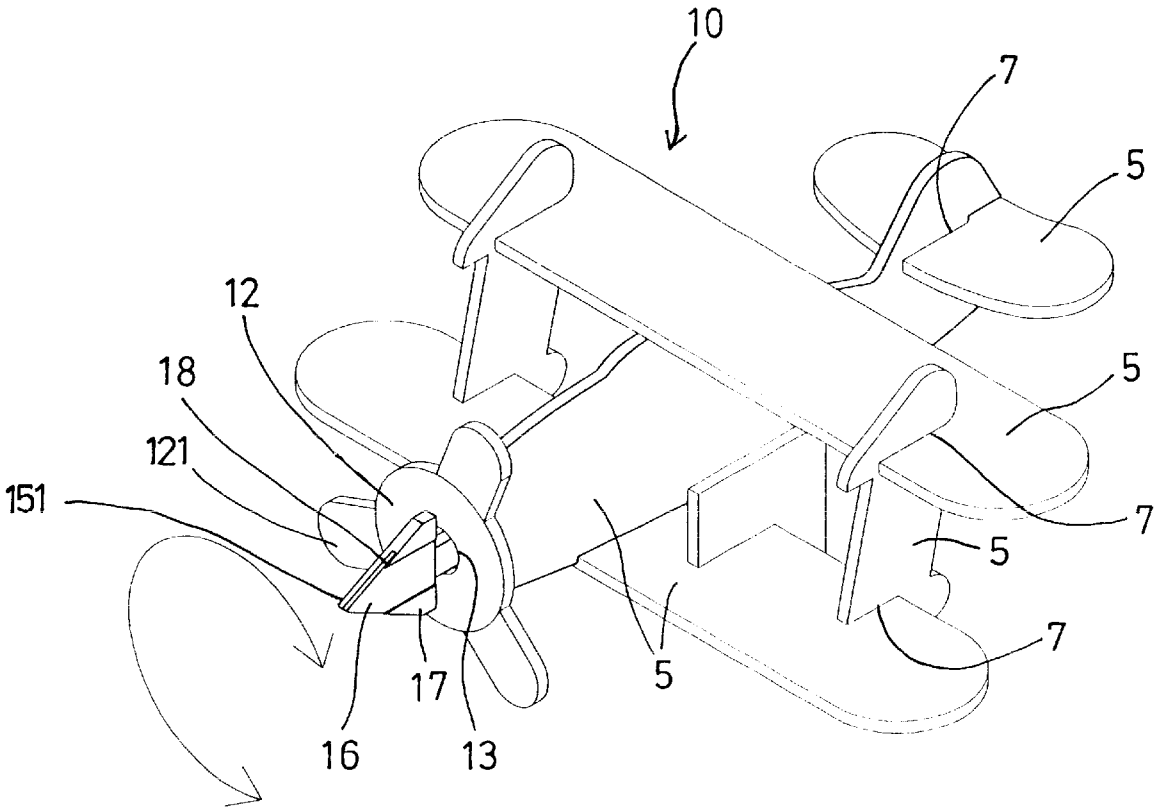
FIG. 1 is a perspective view of a toy construction kit in accordance with the present invention.
Figure 2:
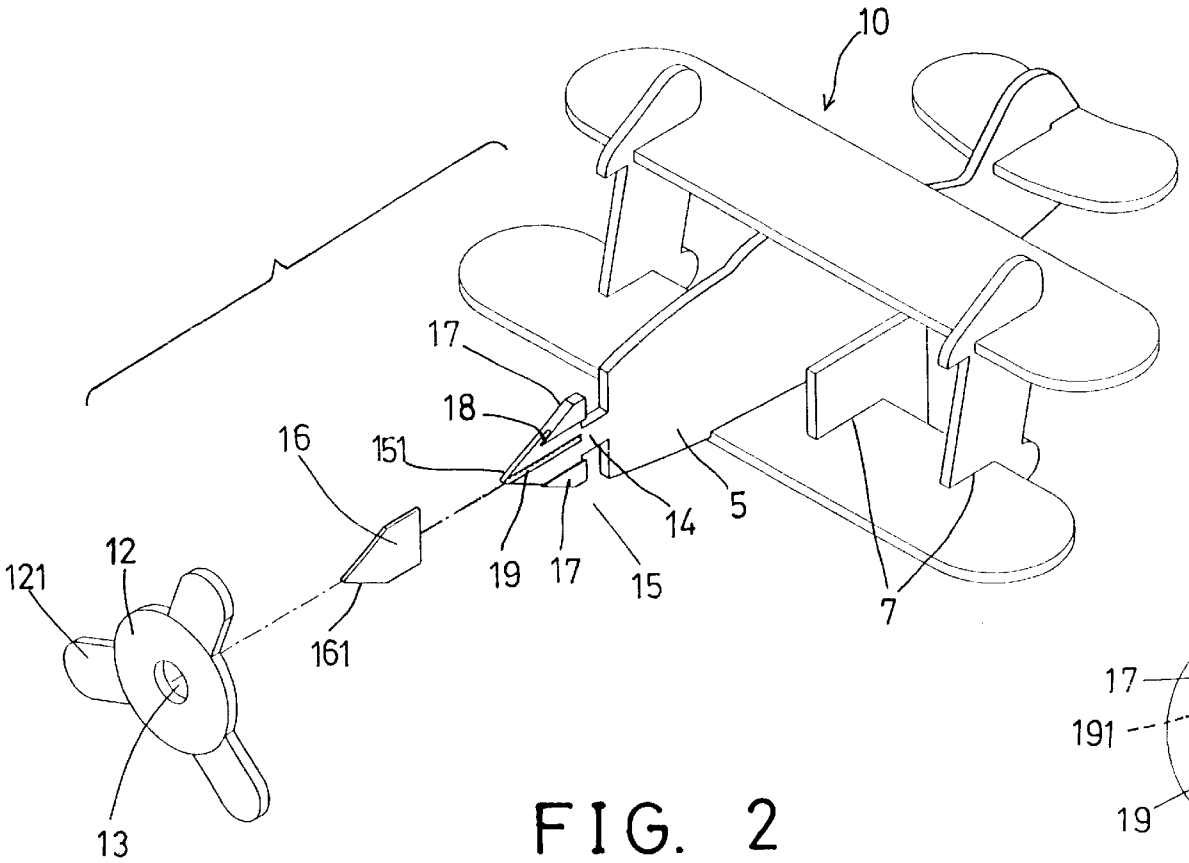
FIG. 2 is a partial exploded view of the toy construction kit.
Figure 3:
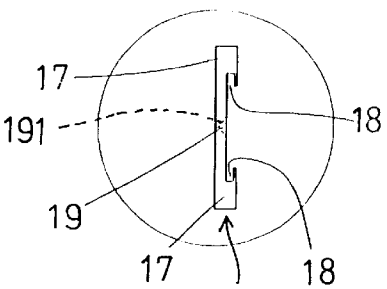
FIG. 3 is an enlarged partial front view of a portion of the toy construction kit.
Figure 4:
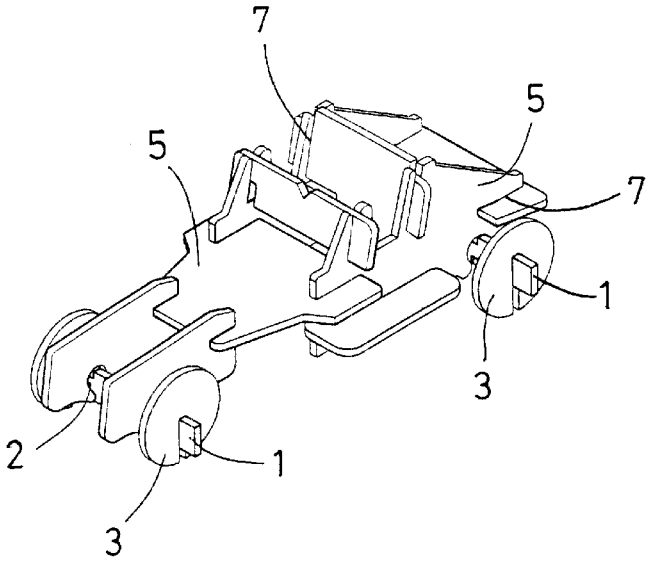
FIG. 4 is a perspective view illustrating the other embodiment of the toy construction kit.
Figure 5:
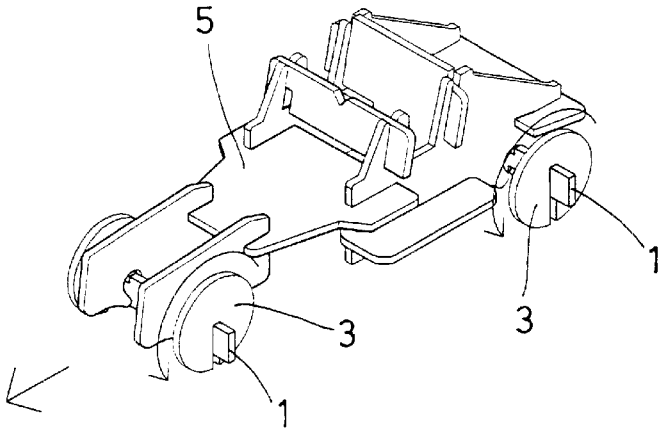
FIG. 5 is a perspective view similar to FIG. 4, illustrating the operation of the toy construction kit as shown in FIG. 4.

Referring to the drawings, and initially to FIGS. 1–3, a toy construction kit 10 in accordance with the present invention comprises a number of elements or members 5 each including one or more slots 7 formed therein for receiving the edges of the other members 5 and for allowing the members 5 to be assembled together with such as a force-fitted engagement. One of the members 5, such as the member located in the middle and front portion of the toy construction kit 10, includes a panel 15 extended forward or provided in front of a neck 14. The panel 15 includes an upper and a lower portions 17 each having a channel 18 formed therein. A longitudinal groove 19 is formed through the panel 15 for forming or defining a hinge portion 191 between the upper and the lower portions 17 of the panel 15, and for allowing the upper and the lower portions 17 of the panel 15 to be folded toward each other.

A movable or rotatable member 12 includes an orifice 13 formed therein for receiving the panel 15 when the upper and the lower portions 17 of the panel 15 are folded toward and to engage with each other. The upper and the lower portions 17 of the panel 15 each further includes an inclined front surface 151 formed therein for further facilitating the engagement of the folded panel 15 through the orifice 13 of the member 12. The member 12 may include one or more elements 121 attached thereto or extended therefrom for decorative purposes, for example, the member 12 may include one or more extensions or blades 121 extended radially outward therefrom for forming a fan device, a propeller device, or the like.

A latch 16 may be engaged into the channels 18 of the panel 15 when the upper and the lower portions 17 of the panel 15 are opened or disengaged from each other, for securing or maintaining the upper and the lower portions 17 of the panel 15 at the open position as shown in FIG. 1, and for preventing the upper and the lower portions 17 of the panel 15 from being folded toward and to engage with each other. The latch 16 preferably includes a pair of inclined surfaces 161 formed in the front portion thereof corresponding to the inclined surfaces 151 of the panel 15, for allowing the inclined surfaces 151, 161 of the panel 15 and the latch 16 to be flush with each other.

In operation, as shown in FIG. 1, the member 12 may thus be rotatably attached onto or retained on the neck 14 of the member 5, after the upper and the lower portions 17 of the panel 15 have been opened or disengaged from each other, and after the upper and the lower portions 17 of the panel 15 have been secured or maintained at the open position by the latch 16. The member 12 may thus be rotated relative to the member 5.

Referring next to FIGS. 4–7, the toy construction kit may also include a number of elements or members 5 each including one or more slots 7 formed therein for receiving the edges of the other members 5 and for allowing the members 5 to be assembled together with such as a force-fitted engagement. The members 5 each preferably includes two rounded side edges or flanges 8 formed beside the slots 7 respectively for allowing the members 5 to be easily engaged into the slots 7 of the members 5. One or more pairs of the members 5, such as the pair of members located in the side and front portion and the pair of members located in the rear side portion of the toy construction kit each includes a hole 6 formed therein and facing downward,and each includes a slit 61 formed therein and communicating with the respective hole 6, and each includes a pair of opposite extensions 62 for forming or defining the slit 61 of the member 5.

The toy construction kit further includes one or more, such as two shafts 1, and one or more, such as two pairs of wheels 3 each having one or more slots 7 formed therein for receiving the edges of the other members 5, 1, 3, and for allowing the members 1, 3, 5 to be assembled together with such as the force-fitted engagement. Particularly, the shafts 1 each includes two ends 2 having the wheels 3 secured thereon and rotated in concert therewith. The shafts 1 have the end portions 2 thereof rotatably engaged into the holes 6 of the members 5 via the slits 61 of the members 5. The shafts 1 may be rotatably maintained within the holes 6 of the members 5 by the weight of the toy construction kit applied onto the shafts 1, when the toy construction kit is disposed on a supporting ground or a table or the like.

Figure 6:
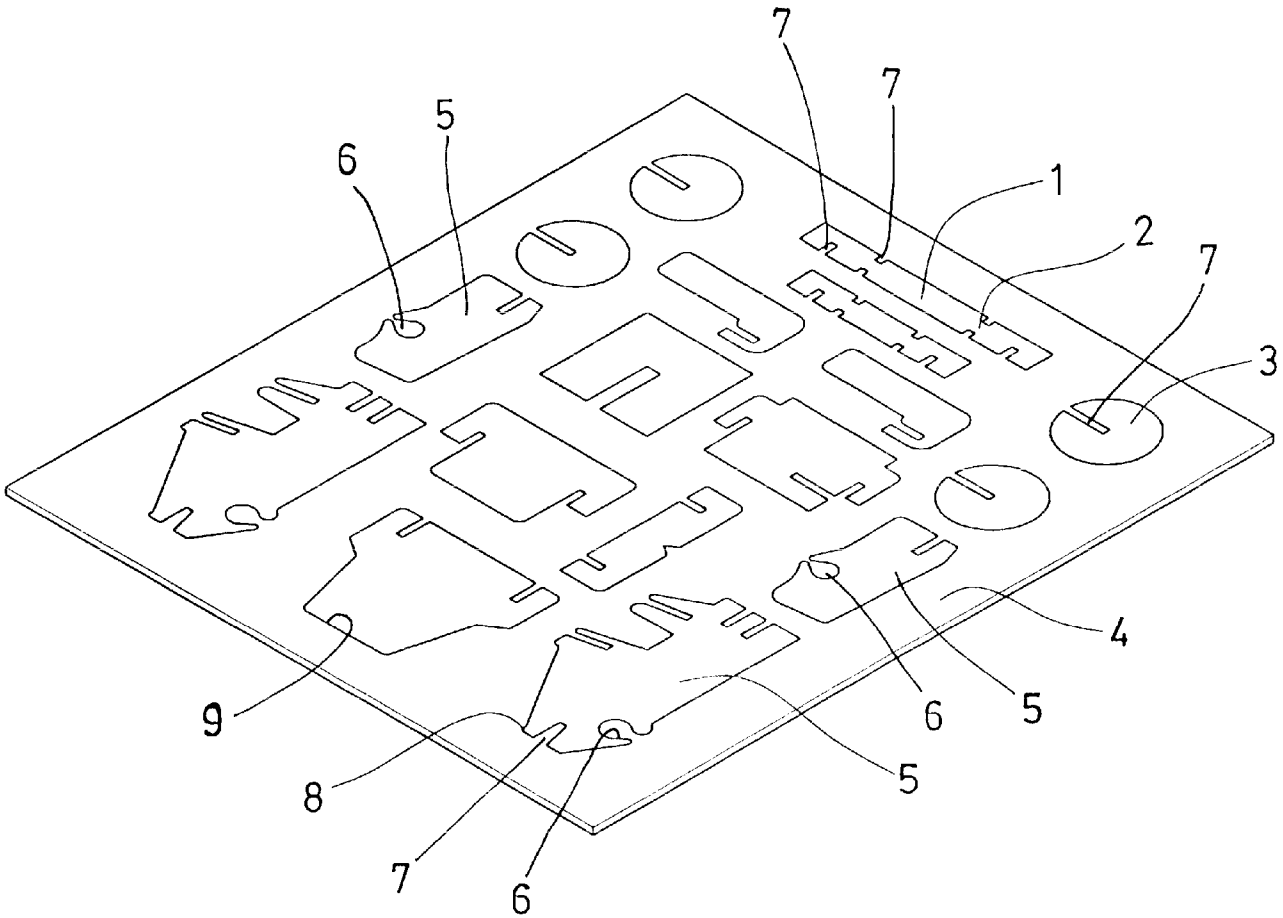
FIG. 6 is an upper perspective view illustrating a plate for forming the toy construction kit.
Figure 7:
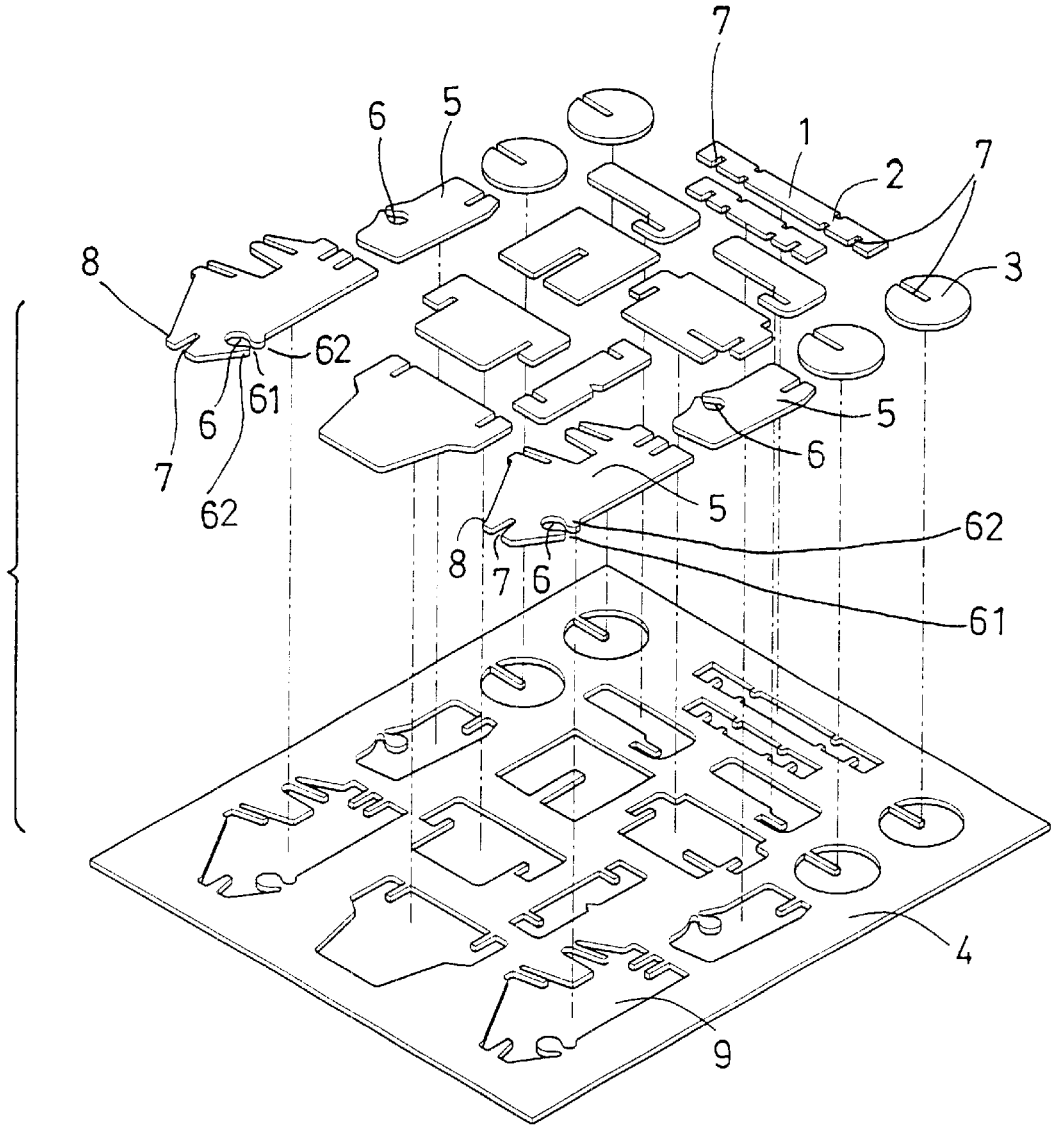
FIG. 7 is an exploded view of the plate as shown in FIG. 6.

As best shown in FIGS. 6 and 7, the toy construction kit may include a plate 4 having a number of openings 9 formed therein for receiving the members 1, 3, 5 which may be cut from the plate 4 and which may be retained in the openings 9 of the plate 4 with such as a force-fitted engagement.

Figure 8:
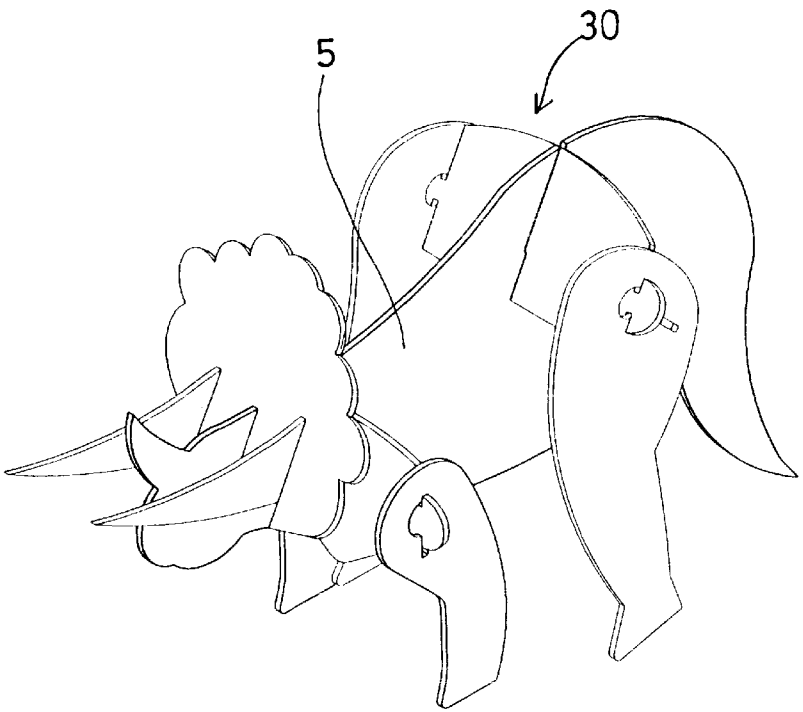
FIG. 8 is a perspective view illustrating a further embodiment of the toy construction kit.
Figure 9:
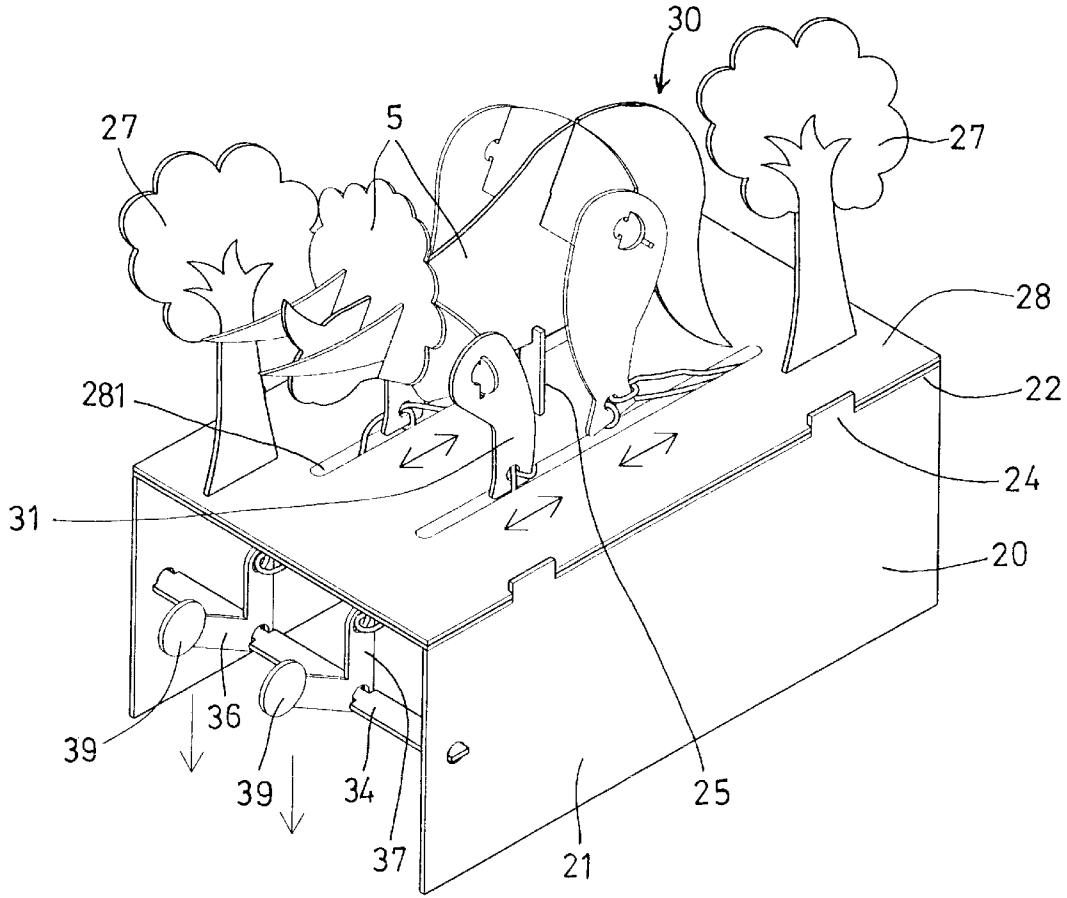
FIG. 9 is a perspective view illustrating a still further embodiment of the toy construction kit.
Figure 10:
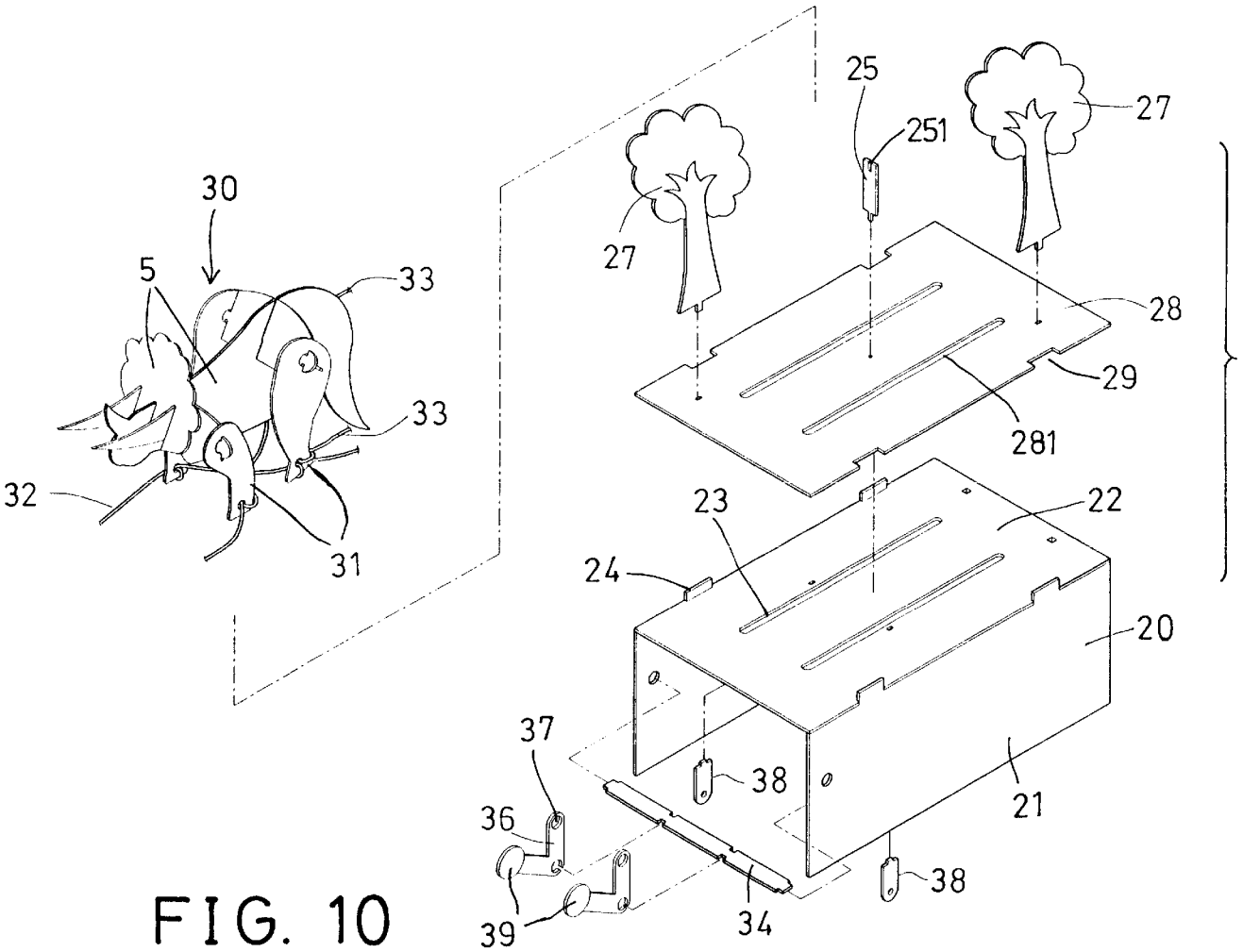
FIG. 10 is a partial exploded view of the toy construction kit as shown in FIG. 9.

Referring next to FIGS. 8–10, the toy construction kit 30 may be formed as an animal or the like, and includes two pairs of legs 31, and includes two cables 32 coupled to the front legs 31 and the resilient cables or springs 33 coupled to the rear legs 31 thereof. A housing 20 includes two side walls 21 and a top wall 22 disposed or provided on top of the side walls 21. The housing 20 includes one or more, such as two channels 23 formed therein, such as formed in the top wall 22 thereof, and includes one or more extensions, such as two pairs of extensions 24 extended upward from the side portions thereof.

A board 28 is further provided and includes two pairs of notches 29 formed in the side portions thereof for receiving the extensions 24 of the housing 20 and for securing the board 28 on top of the housing 20. The board 28 includes two passages 281 formed therein and aligned with the channels 23 of the housing 20 for slidably receiving the legs 31 of the toy construction kit 30. A stay 25 may be secured or disposed on top of the board 28 for supporting the toy construction kit 30 above the housing 20 and the board 28. One or more decorative members 27 may further be provided and secured or disposed on top of the board 28 for decorative purposes, for example. The springs 33 may be coupled between the toy construction kit 30 and the housing 20 for pulling or biasing the toy construction kit 30 rearward of the housing 20.

A shaft 34 is rotatably secured in the housing 20, such as rotatably received in the front portion of the housing 20. One or more arms 36 have a middle portion rotatably engaged on the shaft 34 and rotatable relative to the shaft 34 or relative to the housing 20. The arms 36 each includes one end 37 directly coupled to the cables 32 respectively, or indirectly coupled to the cables 32 with two bars 38, and each includes a handle 39 provided on the other end for rotating the arms 36 and thus for moving the front legs 31 of the toy construction kit 30 relative to the housing 20, against the springs 33, for example.

Accordingly, the toy construction kit in accordance with the present invention includes one or more movable members that may be movably or rotatably attached on a toy construction kit body, for further increasing the education purposes and the recreation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toy construction kit comprising:

a plurality of members each including at least one edge and each including at least one slot formed therein, said at least one edge of said members being selectively engaged in said at least one slot of said members for allowing said members to be assembled together, a first of said members including a neck and a panel extended therefrom, and a rotary member including an orifice formed therein for receiving said neck of said first member and for rotatably securing said rotary member onto said first member, said panel including two portions foldable relative to each other for allowing said portions of said panel to be engaged into said orifice of said, rotary member.

2. The toy construction kit according to claim 1, wherein said panel includes a longitudinal groove formed therein and formed between said two portions thereof for forming a hinge portion between said two portions of said panel and for allowing said two portions of said panel to be folded relative to each other.

3. The toy construction kit according to claim 1 further comprising means for locking said two portions of said panel with each other.

4. The toy construction kit according to claim 3, wherein said locking means includes a latch engaged with said two portions of said panel for locking said two portions of said panel with each other.

5. The toy construction kit according to claim 4, wherein said two portions of said panel each includes a channel formed therein for receiving said latch.

6. The toy construction kit according to claim 4, wherein said two portions of said panel each includes a pair of inclined surfaces formed thereon, said latch includes a pair of inclined surfaces formed thereon and aligned with and flushed with said inclined surfaces of said panel.

* * * * *